United States Patent [19]

Davel

[11] Patent Number: 4,833,783

[45] Date of Patent: May 30, 1989

[54] CAN OPENER WITH CONTINUOUSLY VARIABLE CLUTCH

[76] Inventor: Peter E. Davel, 21 - 4391 Torquay Dr., Victoria, B.C., Canada, V8N 3L3

[21] Appl. No.: 31,776

[22] Filed: Mar. 30, 1987

Related U.S. Application Data

[63] Continuation of Ser. No. 891,451, Jul. 28, 1986, abandoned.

[51] Int. Cl.[4] ..... B67B 7/54

[52] U.S. Cl. ..... 30/422; 30/416

[58] Field of Search ..... 30/410, 422, 442, 433, 30/434, 416

[56] References Cited

U.S. PATENT DOCUMENTS 3,002,275 10/1961 Edlund ..... 30/422

4,574,482 3/1986 van der Wonder ..... 30/422

*Primary Examiner*—Frank T. Yost

*Assistant Examiner*—Willmon Fridie, Jr.

[57] ABSTRACT

In the invention of a manually operated can opener, an angular drive shaft attaches to the upper handle of a pivotally connected pair of handles. At the higher end of said drive shaft, a crank is rigidly attached and at the lower end, to rotate therewith, a combination of a polygonal feed wheel and a cutting wheel forming a gripping groove, attaches. Said gripping groove fits on the top rim of the can to be opened and assisted by a free-rotating smooth-rimmed pressure wheel, which attaches to the lower handle and fits under the bottom lip of the can bead, provides the forward thrust, when the crank is turned, while the cutting wheel pierces and closely cuts the can lid. The gripping groove and pressure wheel combine to form a controllable continuously variable clutch. The polygonal feed wheel also provides a means for the easy removal and replacement of the cutting wheel for cleaning of same.

2 Claims, 1 Drawing Sheet

CAN OPENER WITH CONTINUOUSLY VARIABLE CLUTCH

SUMMARY OF THE INVENTION

This invention relates to a can opener. More specifically it relates to the driving means used for the feed mechanism and cutter mechanism in a can opener.

It is an object of the invention to provide a cutter means and feed means on the same shaft with the power applied directly to said shaft.

More particularly, it is an object of the invention to provide a cutter means and a feed means which can be varied as in a continuously variable clutch, without the use of gears, by the use of a gripping groove which engages the top rim of the can and a smooth-rimmed free-rotating pressure wheel which engages the bottom rim of the can bead.

It is a further object of the invention to provide a means for the quick and easy removal of the cutter from the can opener for the purpose of washing said cutter without difficulty and without washing the lubricants from the bearings in the can opener.

The invention provides a means of replacing the cutter in a firm position after cleaning.

Further objects and advantages of my invention will become apparent from a consideration of the drawings and ensuing description thereof.

DRAWINGS

DESCRIPTION OF THE INVENTION

Figure 1:
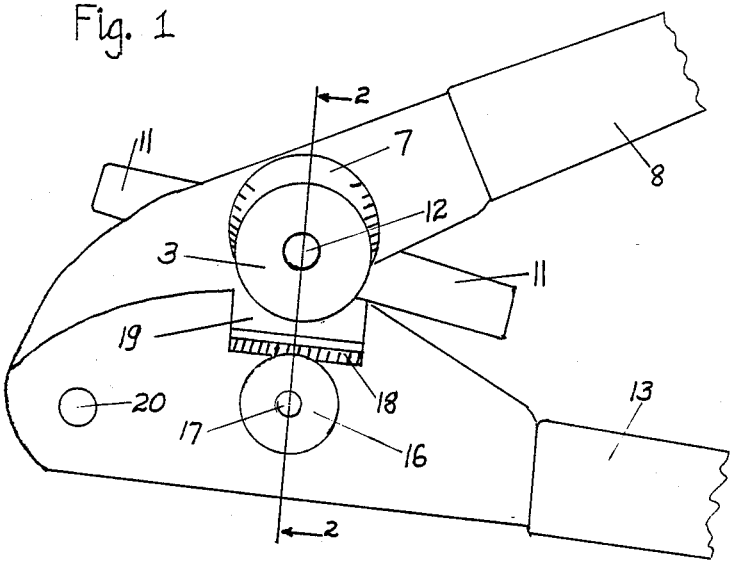
FIG. 1 is a side elevation of a hand-actuated can opener shown in open position.
Figure 2:
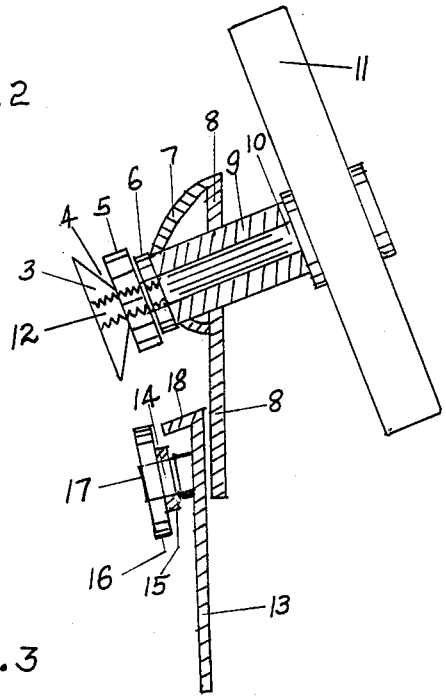
FIG. 2 is a vertical section through the can opener, showing in detail the portion indicated by the section line 2—2 in FIG. 1.
Figure 3:
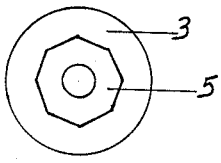
FIG. 3 is a side elevation, from the rear, of the removed polygonal feed wheel and cutting wheel.

At present, all power driven can openers, be they hand-operated or electricaly-operated, employ a jagged-toothed feed wheel which bites into the bottom lip of the bead on the can and to which the power is applied. The power is then indirectly transmitted to either a knife-like blade or a cutting wheel. Some can openers employ a pair of gears to transmit the power from the feed wheel to a rotary cutting wheel.

In my invention the cutting and feed action are directly powered, thereby requiring less power to operate and does not require gears. The use of the clutch can make the operation even easier. Only smooth surfaces make contact with the bead on the can, top and bottom, resulting in a smoother operation.

The clutch feature is of great value to those with physical problems of the hands, especially arthritis sufferers. The clutch also make the invention particularly suitable for electrically driven can openers.

Because the crank on the manually operated version of the invention is set at an angle of approximately 20° instead of vertically, as with other manual can openers, the position of the right hand is in a slightly more natural position for rotating the crank, thereby making the operation easier.

Since the cutter is wedged tightly against the inside wall of the can, the finished cut is clean and leaves the peripheral edge of the can pressed tightly against the inner surface of the side wall of the can.

Can openers observed by the inventor in most households are extremely dirty and could be a breeding ground for harmful bacteria. An important feature of the invention, therefore, is the provision of a simple method of keeping the cutter clean.

This invention provides a can opener which is much more efficient than prior openers, and yet, because of the simplicity of the design, may be manufactured at a relatively low cost.

The can opener of the invention comprises an upper handle 8 a lower handle 13 and a pivotal stud 20 which hinges the two handles. Handles can be of any reasonable design.

The upper handle 8 has a forwardly and downwardly stamped portion 7 upon which is mounted a bearing 9 downwardly inclined towards the centre of the can at an angle of approximately 20° from the horizontal. The bearing 9 contains a rotatable driving shaft 10 upon one end of which is mounted a crank 11. At the other end, the shaft 10 has a reduced threaded portion 12 on which is tightened a lock-nut 6 to retain the shaft 10 within the bearing 9. Also screwed into the shaft 10 are the feed wheel 5 and cutting wheel 3 which is machined at an angle of approximately 20° from the vertical to match the inclination of the driving shaft 10, thereby keeping the inside face of the cutting wheel, at the point of contact with the can, substantially parallel with the upper handle 8. Said angular cutting wheel and feed wheel 5, which is one integral unit, form the gripping groove 4; an essential part of the variable clutch.

Providing the thrust for the variable clutch is the pressure wheel 16 which is a smooth-rimmed wheel rotating freey around a stub shaft 14 fixed to the lower handle 13. The bearing 15 is an integral part of the pressure wheel 16. To retain the pressure wheel, the stub shaft 14 is lightly riveted at its outer end 17 where no pressure is applied.

An important feature of the can opener is the fact that the stub shaft 14 is fixed at a small angle downward from its outer end to the lower handle 13. The effect of this, is a tilting of the pressure wheel 16 so that the bottom circumference of said pressure wheel stands away from the side wall of the can while the top circumference rides under the lip of the can bead. The purpose is to eliminte any possible friction between the face of the pressure wheel 16 and the can wall.

For the purpose of removing the cutter wheel 3, the feed wheel 5 is polygonal in shape. The flange 18 is stamped out from the lower handle 13 to leave a gap 19 is FIG. 1. This flange is set downward, at its outer end, at an angle of approximately 20° or parallel with the polygonal edge of the feed wheel 5. The function of the flange is to provide a lock for the feed wheel 5 so that when the crank 11 is turned in a counter clockwise direction, said feed wheel and with it cutting wheel 3 will unscrew for cleaning.

The flange 18 is positioned just above and behind the pressure wheel 16 so that it is low enough not to touch the feed wheel 5 when a can is in the can opener but high enough to make firm contact with the polygonal edge of the feed wheel 5, when the handles are closed, with no can in the way.

In the operation of the can opener the gripping groove 4 is placed on the top lip of the can to be opened. When the upper handle 8 and lower handle 13 are closed with the left hand, the pressure wheel 16 engages the bottom lip of the can bead. The crank 11 is turned in a clockwise direction with the right thumb and forefinger. With a little pressure applied with the left hand, the first part of the turn causes the cutting wheel 3 to puncture the can. Continued pressure on the handles causes the top of the can lip to be wedged into the gripping groove 4 and the cutting wheel 3 to be driven in a forward direction as the crank 11 is turned. Pressure applied by the left hand is important. Sufficient pressure must be applied to prevent the cutting wheel 3 from riding up on top of the can lid. Beyond that, the left hand pressure on the handles 8 and 13 controls the forward drive of the cutting wheel 3 and hence the amount of power required of the right hand to rotate the crank 11. This is a natural and simple operation based on the ordinary feel of the hands.

The equivalent amount of left hand pressure as is required to operate any other hand-actuated can opener will cause the cutting wheel 3 to be driven forward in a positive manner. That is, without any slipping action. In this instance, the power required from the right hand will be approximately equal to that required to turn the crank of the better made can openers, with gears, currently being marketed. However, when required, the pressure of the left hand can be eased which will cause the gripping groove 4 to slip somewhat on the can lip, thereby making the turning of the crank 11 easier. This left hand action can be varied to any degree, except as already indicted, thus converting the gripping groove 4 into a controllable continuously variable clutch.

To remove the cutting wheel 3 for cleaning, close the handles fully, with no can in the way, which causes the ploygonal feed wheel 5 to lock against the flange 18. Turning the crank 11 in a counter clockwise direction will cause the feed wheel 5 and with it the cutting wheel 3 to be unscrewed and removed.

To replace, screw unit back on, close handles and turn crank clockwise until tight.

While the above description contains many specificities, these should not be construed as limitations on the scope of the invention, but rather as an exemplification of one preferred embodiment thereof. Other variations are possible, for example:

A ball-filled bearing could be substituted for the pressure wheel 16, the cutting wheel 3 and feed wheel 5 shown as one unit could be separated, but would necessitate slight modifications to enable said cutting sheel to be unscrewed, a variation between the machined angle of the cutting wheel 3 and the angle of incline of the bearing 9 will cause the handles to tilt correspondingly which would have the same effect as tilting the stub shaft 14, a bottle opener could be cut into the lower handle 13.

Accordingly, the scope of the invention should be determined not by the embodiment illustrated, but by the appended claims and their legal equivalents.

I claim:

1. A can opener comprising:

a rotatable inclined drive shaft positioned above the can to be opened, with the rotating power applied at the higher end of said inclined shaft and a cutting wheel mounted at the lower end of said inclined shaft, to rotate therewith, so that the rotating power is effectively applied directly to said cutting wheel, the inside face of which is machined at substantially the same angle as the incline of said shaft, a smooth rimmed feed wheel mounted adjacent to said machined face of said cutting wheel on said shaft, to rotate therewith, so that said feed wheel and said cutting wheel together form a friction gripping groove which rides on top of the rim of the can and provides the forward drive of said cutting wheel when said shaft is rotated, a smooth rimmed pressure wheel freely rotatable about a stub shaft and which rides under the rim of the can, said presure wheel cooperating with said gripping groove to form what is in effect a continuously variable clutch, means for varying the pressure betweens aid pressure wheel and said gripping groove thereby varying the degree of friction between said gripping groove and the can rim to activate said variable clutch.

2. The can opener of claim 1 further including:

means for locking said smooth rimmed feed wheel so that, when the rotation of said drive shaft is reversed, said feed wheel and said cutting wheel with it are unscrewed to facilitate cleaning of said cutting wheel, means for replacing said feed wheel and said cutting wheel in a firm position after cleaning.

* * * * *